United States Patent [19]

Ibrahim et al.

[11] Patent Number: 4,577,467

[45] Date of Patent: Mar. 25, 1986

[54] FROST DIFFUSION SYSTEM FOR REFRIGERATION APPARATUS

[75] Inventors: Fayez F. Ibrahim; Edward E. Bowman, both of Niles, Mich.

[73] Assignee: Tyler Refrigeration Corporation, Niles, Mich.

[21] Appl. No.: 666,327

[22] Filed: Oct. 30, 1984

[51] Int. Cl.[4] ..... A47F 3/04

[52] U.S. Cl. ..... 62/82; 62/256; 165/146; 165/151

[58] Field of Search ..... 62/256, 82, 282; 165/151, 146; 55/419

[56] References Cited

U.S. PATENT DOCUMENTS

| | | | |
|---|---|---|---|
| Re. 31,909 | 6/1985 | Ibrahim | 62/256 X |
| 2,553,657 | 5/1951 | La Porte | 62/82 |
| 3,199,581 | 8/1965 | Kritzer | 165/151 X |
| 4,044,751 | 8/1977 | Johnson | 126/91 A |
| 4,117,698 | 10/1978 | Vogel | 62/256 |
| 4,295,340 | 10/1981 | Abraham | 62/256 X |
| 4,338,792 | 7/1982 | Ibrahim | 62/256 |
| 4,370,866 | 2/1983 | Abraham | 62/256 |
| 4,483,153 | 11/1984 | Wallace | 62/82 X |

*Primary Examiner*—William E. Tapolcai

[57] ABSTRACT

An improved evaporator unit in which a cooling tube core is placed between guide panels which permit a portion of the refrigerated air band to by-pass the front air opening of the core and to thereafter be forced into the core along a substantial longitudinal length of one or more side air openings. The flow of an auxilliary portion of the air stream into the side air opening permits the diffusion of frost build-up within the cooling tube core. A heater is provided for use during a defrost cycle in order to add heat directly into the cooling tube core. The improved evaporator is designed for use with reverse flow air defrost refrigerated container apparatus. Use of the evaporator permits improved refrigeration and defrost cycle operation.

34 Claims, 12 Drawing Figures

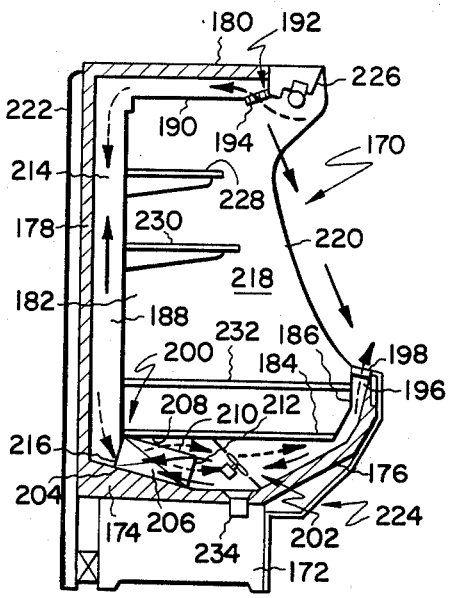
FIG. 4
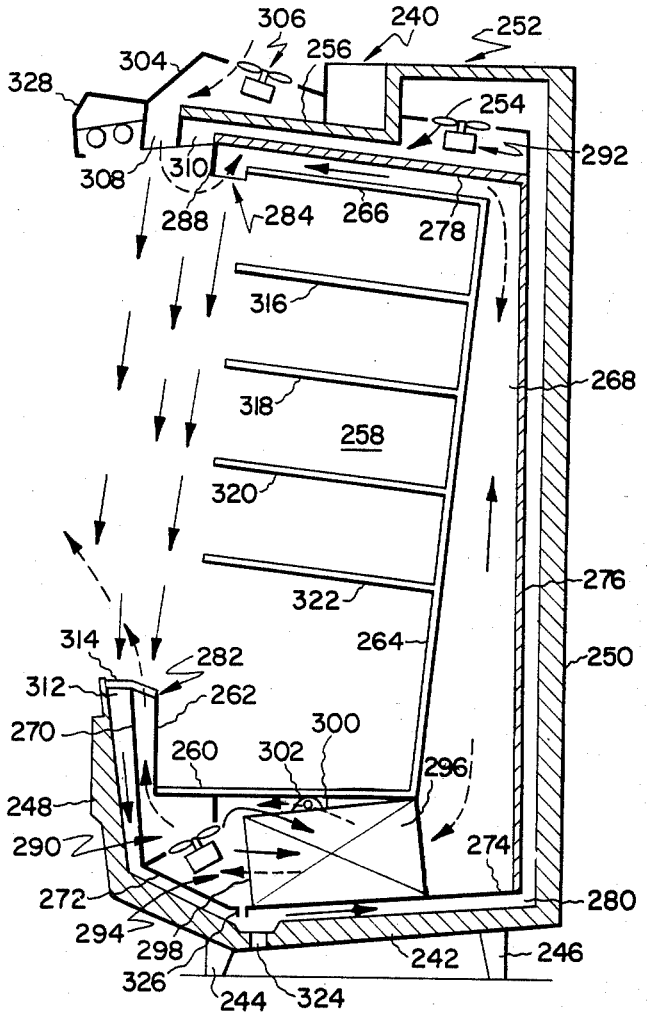
FIG. 5
FIG. 6
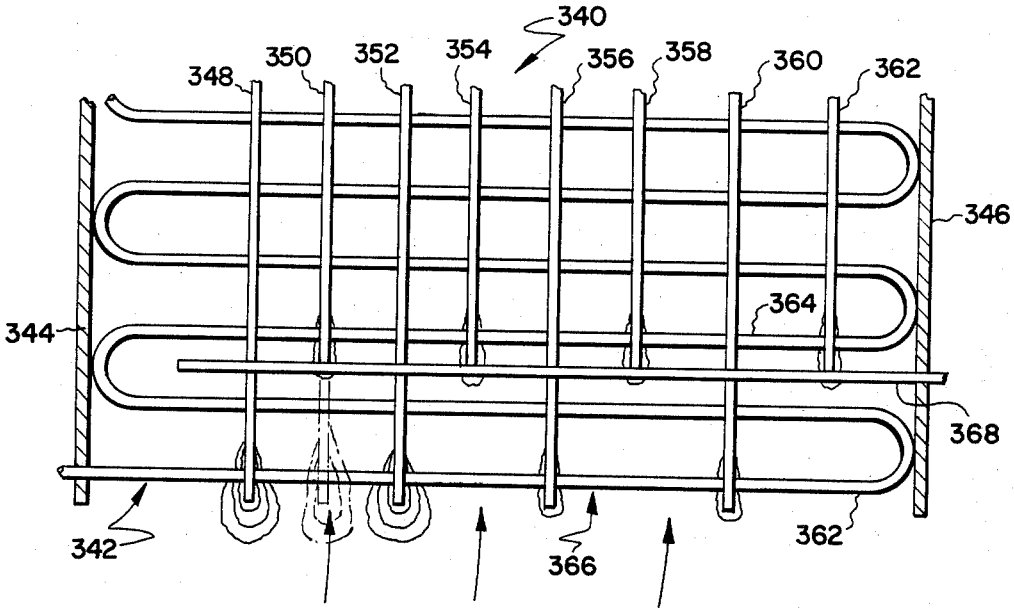

FROST DIFFUSION SYSTEM FOR REFRIGERATION APPARATUS

BACKGROUND OF THE INVENTION

The present invention relates to a refrigerated container apparatus having a refrigeration unit which permits inflow of air for cooling from multiple directions to diffuse frost buildup. The invention relates particularly to refrigerated display cabinets which have access openings therein and thus are particularly susceptible to frost buildup. The improved evaporator unit comprises a cooling tube core and associated housing panels for positioning within the refrigerated apparatus.

Commercial refrigerated apparatus have heat extracted by evaporator units. These units are connected as part of a refrigeration circuit comprised of one or more compressors, a condenser system, a receiver, an expansion valve, and one or more evaporators. The refrigerated is compressed by the compressors and pumped through the circuit in the above order as a high pressure gas from the compressor to the condenser system and thereafter is handled as a high pressure liquid until it is expanded to a lower pressure through the expansion valve. The low pressure side extends from the expansion valve through the evaporators to the suction intake of the compressor.

In refrigerated display units air is utilized as a medium of heat exchange between the evaporator unit and the products to be maintained at a low temperature. In refrigerated apparatus where barrier doors are utilized to separate the cooled air within the apparatus from the moist ambient air, refrigeration cycles can extend for long periods with only occasional defrosting cycles in order to clear the evaporator coils from the frost and ice buildup.

In refrigerated apparatus where frequent entry is made into the apparatus for the placement of products to be cooled and for extraction of products as in retail food stores frost and ice buildup in the evaporator units can be quite rapid. Typically two defrost cycles are required per day for removing the frost and ice from the evaporator units in such apparatus. The problem of ice and frost formation is particularly acute in those refrigerated apparatus having access openings through which store personnel stock products into the apparatus and through which customers remove product. In these apparatus a refrigerated air band is circulated from an air outlet across the access opening to an air inlet and thereafter is propelled through an internal air conduit and into contact with the evaporator unit in order to cool the same. Variations of such apparatus permit one or more secondary and guard air bands to be used to further protect the refrigerated air band against contact with the ambient moist air. These additional air bands while helpful, still do not sufficiently protect the refrigerated air band to sufficiently reduce the frequency of defrost cycles to an optimum low level.

In the operation of all types of refrigerated display cabinets, it is desirable to include a system for automatically defrosting the evaporator unit. The defrost cycle can be actuated either at set periodic time intervals. Or when the frost buildup within the system has reached a certain predetermined level. Such latter type of systems are typically thermostatically controlled so as to switch from a refrigerated cycle to a defrost cycle of operation.

There have been three different approaches for defrosting refrigerated apparatus in this art. These are utilizing electric resistance heaters; passing a compressed refrigerant gas having a high specific heat content through the refrigeration coils; and, circulating ambient air through an air conduit in which the refrigeration coils are positioned. Due to the increased cost of energy, wide spread efforts have been made to place more emphasis on the utilization of ambient air defrost systems as an alternative to the electrical resistance heaters or compressed refrigerant gas defrost systems.

Barrier doors have been used in refrigerated apparatus in order to reduce the contact between the ambient air and the internally circulated refrigerated air band. Representative U.S. Patents are U.S. Pat. Nos. 4,265,090 to Ibrahim and 4,312,190 to Ibrahim and Perez. In some refrigerated display cases having barrier doors multiple air bands are employed for additional protection for the refrigerated air band as exemplified by U.S. Pat. Nos. 4,299,092, 4,369,631 and 4,369,632 all, to Ibrahim.

As shown by FIG. 2 of U.S. Pat. No. 4,312,190, the flow of refrigerated air through the evaporator coils in these units is in a single direction from the front end to the back end in the direction of the refrigerated air band flow. This flow pattern for the refrigerated air band results in the front end of the evaporator coils becoming heavily coated with frost and ice whereby the air flow is reduced. Upon the accumulation of sufficient frost and ice the air flow through the evaporator coils is greatly reduced at which time the cooling capacity of the refrigerated apparatus is seriously decreased. A defrost cycle must then be initiated in order to clear the evaporator coils of the accumulated ice and frost.

The evaporator coil units used for cooling the air bands in the above refrigeration apparatus are constructed by placing a cooling tube core which consists of one or more serpentine arranged refrigerant tubes within a series of parallel arranged cooling fins. This core unit is then surrounded by housing panels which provide for air flow therethrough in planes parallel to the planes established by the cooling fins. This type of arrangement is shown in U.S. Pat. No. 4,361,012, FIGS. 4 and 5, to Ibrahim. In these units the housing panels wall off any inflow of the air band from portions of the cooling tube core other than the front and top sides which are perforated. The use of perforated housing panels for the cooling tube core permits a wider distribution of the air contact with the cooling tube core elements but results in air blockage at the perforation openings due to buildup of ice and frost on the fins immediately under the perforations. This type of cooling tube core arrangement is also illustrated in FIGS. 18 and 19 of U.S. Pat. No. 4,369,632, mentioned above.

In one employment the housing panels have been removed from portions of the cooling tube core in order to permit cross flow of air bands into contact with a portion of the evaporator coils in order to create a cooled secondary air band as shown in U.S. Pat. No. 4,389,852 to Ibrahim. As shown in this patent the lower portion 36 of the evaporator coils is exposed to cross flow by a secondary band. In this arrangement the entire air band does not exit through the opposite end of the cooling tube core and there are no guide panels associated with the core which distribute the incoming air band to be cooled over a substantial length of the cooling tube core in the direction of air band movement. The main ice and frost accumulation in this type of unit is in the lower portion 36 of the cooling coils rather than distributed through the cooling coils and fins in the evaporator unit 24.

Japanese Published Patent Application No. 52 32154 shows a cooling tube core arrangement in which the air band is diffused for better heat exchange contact with the cooling tubes and fins. The primary ice and frost accumulation in this unit will be at the lower end of the tube core and will not be distributed along the longitudinal length of the tube core in the direction of air band flow due to the suspension brackets which limit flow along the sides of the cooling tube core.

U.S. Pat. No. 3,898,864 shows a plenum chamber which functions to permit continued air flow when the primary coil inlet becomes frosted closed. A host collection cavity is provided which would result in incomplete defrosting if reverse defrost air flow were to be used.

Other patents which show refrigerator coils not designed for reverse defrost flow are U.S. Pat. Nos. 2,152,291 and 3,364,696. U.S. Pat. No. 3,147,602 which discloses an evaporator designed for frost distribution does not show air defrost or reverse defrost air flow means.

In refrigerated apparatus which have conventional multiple separated cooling tube cores it is the cooling core which is first contacted by the refrigerated air which develops the ice and frost which then eventually constricts the air passages and requires the initiation of a defrost cycle. U.S. Pat. No. 4,369,631 shows a number of case constructions with multiple cooling tube elements. In FIGS. 10–13 it is evaporator 424 which will encounter the greatest problem with respect to the need for defrost.

The improved evaporator unit of the present invention is designed to function as the initial contact unit for a circulated air band. This improved unit diffuses the frost and ice buildup over a large area within the cooling tubes and fins since the air band inward flow is from at least two and, preferably, a plurality of directions along a substantial length of the cooling tube core in the direction of air band flow.

Another feature of the present invention is the utilization of a staggered cooling fin arrangement which then places the ice and frost accumulation on the leading edge of adjacent fins at different longitudinal positions. A preferred feature is to employ a heating source which can direct heat radiant energy into the cooling core tubes and fins during a defrost cycle.

SUMMARY OF THE INVENTON

The improved evaporator unit of the present invention has a cooling tube core formed of a serpentine arranged refrigerant tube system and a series of parallel arranged cooling fins which are interconnected to the cooling tubes which extend transversely between the cooling fins. Guide panels are associated with the cooling tube core to permit an auxiliary portion of the air band to by-pass the front air opening of the core and to thereafter be forced into the core along a substantial longitudinal length of the core in the direction of air flow movement. The guide panels are arranged in a converging relationship with the side edges of the cooling fins whereby the auxiliary portion of the air stream is forced to flow inwardly between the cooling fins and into contact with the serpentine arranged cooling tube within the core. The main stream of the air band enters the front air opening of the cooling tube core and flows longitudinally through the core in the spaces between the parallel arranged cooling fins. The improved evaporator unit is placed into the refrigerated case so that it is the first refrigerated element contacted by the air stream after the access opening of the case. The evaporator unit is adapted to permit reverse through flow of defrost air for use in high efficiency, low cost defrosting. A heat source and a defrost air deflector panel can be used to increase the defrost efficiency.

A preferred feature is to locate a radiant heat source adjacent to the cooling tube core juxtaposed to the side air opening thereof for use during a defrost cycle.

Another preferred practice is to stagger the leading edges of the cooling fins so that adjacent fins are at different longitudinal positions within the cooling tube core. In this fashion frost and ice buildup on the adjacent fins are at different longitudinal positions whereby close off of the air band aperatures formed by the adjacent fins is reduced.

It is therefore an obJect of the present invention to provide an improved evaporator unit having a frost diffusion system capability.

Another object is to provide an evaporator unit for refrigerated container apparatus which is formed from a cooling tube core and associated guide panels which permit the inflow of the air band over a wide contact surface area within the cooling tube core. A radiant heat source can be provided for improved defrost operations.

Another object is to provide a process for refrigerating and defrost a refrigerated container apparatus as herein described in which a frost diffusion system is provided whereby a low defrost to refrigeration cycle time is obtained.

These and other objects of the present invention will become apparent from the following drawings and description of the preferred embodiments.

BRIEF DESCRIPTION OF THE DRAWINGS

FIG. 4 is a schematic cross-sectional view of a single air conduit open front refrigerated display case with an improved evaporator unit;

FIG. 5 is a schematic cross-sectional view of a multiconduit open front refrigerated display case showing the improved evaporator unit of the present invention;

FIG. 6 is a detailed top view of a preferred embodment of the cooling tube core of the improved evaporator unit;

DESCRIPTION OF THE PREFERRED EMBODIMENTS

Figure 1:
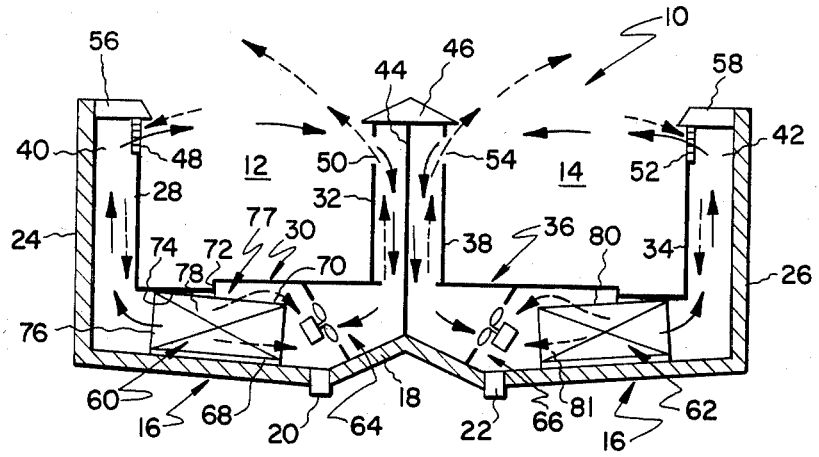
FIG. 1 is a schematic cross-sectional view of an open top island-type refrigerated display case showing two of the improved evaporator units of the present invention.

A double well island-type refrigerated display cabinet 10 is shown in FIG. 1 with a first well or compartment 12 and a second well or compartment 14 both of which form product storage compartments. The wells 12 and 14 are contained within the case bottom wall 16 which has a centrally located and upwardly directed "v" section 18 and drains 20 and 22. Side walls 24 and 26 are connected vertically to the outer edges of the base wall 16. The well 12 is formed by a conduit panel 28 which is positioned parallel to side wall 24 and a bottom conduit wall 30 which is disposed in a parallel fashion to the case bottom wall 16. The inner edge of bottom conduit wall 30 is connected to a vertical conduit wall 32. In a similar fashion well 14 is formed by an outer conduit wall 34 which is connected at its bottom edge to a bottom conduit wall 36 which is in turn connected by its inner edge to a vertical inner conduit 38.

The positioning of the bottom wall 16 and the vertical side walls 24 and 26 from the above described conduit walls forms a first air conduit 40 which is positioned around the sides and bottom portion of well 12 and a second air conduit 42 positioned peripherally about well 14. An internal divider conduit 44 is positioned between the inner conduit walls 32 and 38 and is designed to contact the apex of the "v" shaped bottom 18. A triangular shaped conduit element 46 is positioned to contact the upper edges of conduit wall 32, 38 and 44.

An air opening 48 is formed in the upper portion of conduit wall 28 and an aligned air opening 50 is formed in the upper portion of inner conduit wall 32. In a like fashion an outer air opening 52 is formed in conduit wall 34 of well 14 and an inner air opening 54 is formed in inner conduit wall 38. A hood 56 is provided for conduit 40 over air opening 48 and a hood 58 is provided for conduit 40 over opening 52. If desired the air openings can be fitted with air diffusers as shown in openings 48 and 52.

A cooling tube core 60 is positioned below well 12 on bottom wall 16 and a corresponding core unit 62 is positioned below well 14 in conduit 42 on bottom wall 16. A first air fan and panel unit 64 is provided for propelling an air band within conduit 40 and a second air fan and mounting panel unit 66 are provided for propelling a separate air band within conduit 42.

The refrigerated air band propelled within 40 during a refrigeration cycle is shown by solid arrows. During a defrost cycle the air fan unit 64 is reversed in order to cause the defrost air band to flow within the conduit 40 and to be expelled outwardly and across the side wall 24. The flow pattern for the conduit 42 is shown in the same manner.

The bottom conduit panels 30 and 36 are configured to function as guide panels for permitting unimpeded inflow of the refrigerated air band from at least two directions during a refrigeration cycle. The refrigerated air band can flow directly into the front air opening 68 of cooling unit 60 and another portion of the refrigerated air band can flow into the side air opening 70 of the cooling unit 60 due to the spaced positioning of the guide or bottom wall 30 from the side of the evaporator unit. A connecting guide panel 72 is connected between the guide panel 30 and a second guide panel 74 which rests in contact with the cooling unit 60. The effect of these interconnected guide panels is to permit a portion of the refrigerated air to flow in parallel along the side air opening 70 of cooling unit 60 and to thereafter flow through the cooling unit 60 and then out of the back air opening 76 of the cooling unit. The bottom wall 16 of case 10 functions as a second guide panel on the bottom of the unit 60.

The increased area of flow between the refrigerated air stream and the unit 60 at both the front air opening 68 and the side air opening 70 results in a diffusion of the frost and ice over the edge and internal portions of the evaporator unit as will be described in greater detail below. The evaporator unit 77 which comprises the cooling tube core 68 and the associated guide panels 16, 30, 72 and 74 provides a frost diffusion system in addition to providing the conventional cooling function for the refrigerated air stream.

The cooling unit 62 operates in the same fashion with respect to the refrigerated air stream flowing within conduit 42 by reason of the spacing of the guide panel 36 away from the side portion 80 of the evaporator unit 62. The air band in conduit 42 flows through both this side air opening 80 and the front air opening 81 to achieve frost diffusion.

Figure 2:
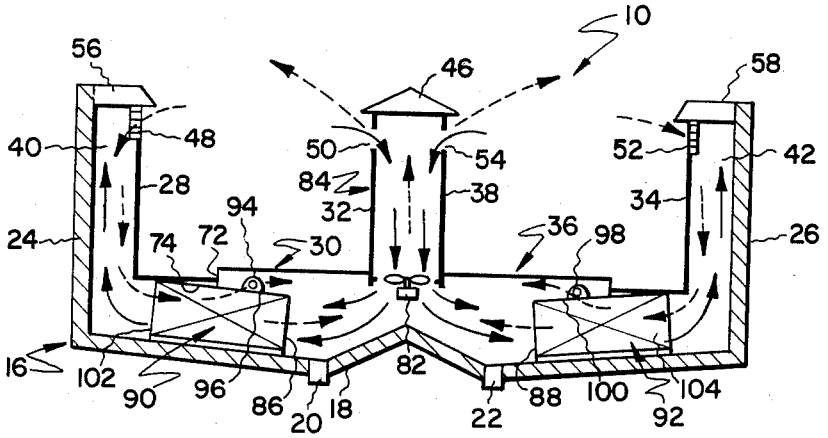
FIG. 2 is a modification of the open top island-type display case of FIG. 1 wherein a single air propelling fan is employed together with two improved evaporator units.

In FIG. 2 another modification of the double well island type refrigerated display cabinet shown in FIG. 1 is illustrated. In this modification a single air band propelling fan 82 is positioned in a central plenum 84 which does not have an internal dividing conduit panel. The refrigerated air stream shown by the solid arrows is moved downwardly through the air openings 50 and 54 (identical numerical designations have been use for the refrigerated case of FIG. 2 where these components are the same as for FIG. 1). This refrigerated air stream is then divided by the "v" bottom configuration and is then divided between flow into the front air openings 86 and 88 of two cooling units 90 and 92. A heater calrod and reflector hood 94 is positioned on side portion 96 of evaporator unit 90 and a similar calrod and reflector hood 98 is positioned on side portion 100 of evaporator unit 92. The purpose of the calrod is to provide additional heat input during the defrost cycles.

During a refrigeration cycle the divided air band flows through the front air openings 86 and 88 and the side air openings 96 and 100 of the two evaporator units and then is propelled out of the back ends 102 and 104 of these two evaporator units. The contact of the refrigerated air over an enlarged surface contact area within the cooling tube core of the units 90 and 92 results in diffusion of the frost and ice buildup. During the defrost cycle, air is propelled in the reverse direction by fan 82 and the calrods 94 and 98 are energized to cause radiant heat energy to be provided for the internal components of the evaporator units. This radiant heat energy permits faster defrosting of the two units.

Figure 3:
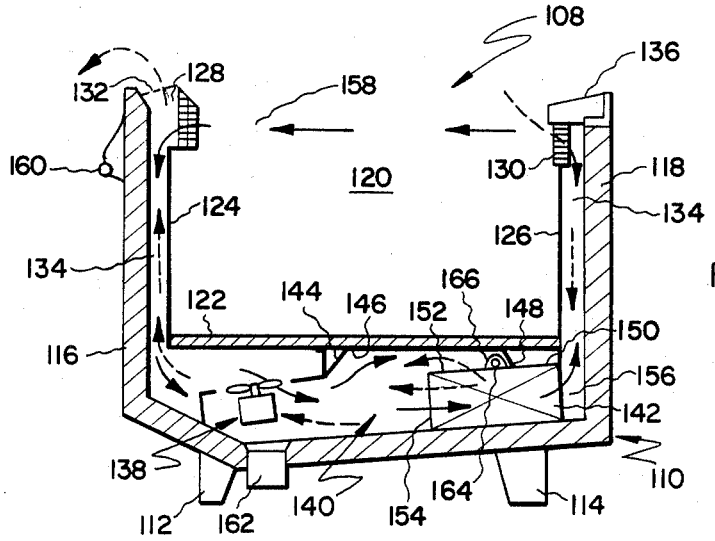
FIG. 3 is a schematic cross-sectional view of a single well open top display case showing a single improved evaporator unit of the present invention.

In FIG. 3 a single well open top refrigerated display cabinet is shown with bottom wall 110 supported by legs 112 and 114. The bottom wall is connected at front and rear edges positioned with a front vertical wall 116 and a rear vertical wall 118, respectively. A product storage compartment or well 120 is formed within the above described outer walls by a bottom panel 122 which is spaced above the outer bottom wall 110 and is connected on the front edge by conduit panel 124 and a vertical rear conduit panel 126. A front air opening 128 is positioned at the top of conduit panel 124 and a rear air opening 130 is positioned at the top of conduit panel 126. A perforated grill 132 is positioned at the top of the front portion of conduit 134 and a hood 136 is positioned at the top of the rear portion of the conduit 134. An air propelling fan and mounting bracket unit 138 is positioned in the space between the bottom outer wall 110 and the bottom compartment panel 122. Also the evaporator unit 140 is positioned within the bottom space of conduit 134. A cooling tube core 142 is positioned to contact the upper surface of bottom wall 110 as shown. Air guide panels 144, 146, 148 and 150 are serially connected between the mounting bracket of the fan unit 138 and the top portion of the cooling tube core 142. The spacing between the air guide panel 146 and the top side 150 of the tube core 142 provides for the bypass flow of a portion of the refrigerated air band through the side air opening 152. In this manner a portion of the refrigerated air band bypasses the front air opening 154 of tube core 142. The positioning of guide panels 148 and 150 result in both the main refrigerated air band flow through front end 154 and the auxiliary, bypass flow through side air opening 152 both exiting from the cooling tube core 142 from back end 156. During the refrigeration cycle of operation the refrigerated air band flows in a counter clockwise direction as propelled by fan unit 138.

In the defrost mode of operation the fan unit 138 is operated in the reverse direction and the air flow is denoted by dashed arrows through the back air opening 156 of cooling tube core 142 and then through both of the front air opening 154 and the side air opening 152 of cooling tube core 142. The defrost air band then flows upwardly through conduit 134 and through the perforated grill 132 and outwardly away from the access opening 158 of the display case 108.

A rub rail 160 is provided on the front side of outer wall 116 and a bottom drain 162 is provided in the sloped bottom wall 110. The outer case walls 110, 116 and 118 can preferably be thermally insulated as shown.

In the embodiment shown in FIG. 3 a calrod heater 164 which has a heat reflector shield 166 is positioned over the side air opening 152 in order to direct radiant heat downwardly through the cooling tube core 142 during a defrost cycle. The heat radiated downwardly is taken up by the metal of the tube core and the moving defrost air band to more quickly melt the accumulated ice and frost from the internal portions of the tube core.

The combination of the evaporator unit 140 having the cooling tube core 142 and the air guide panels 144, 146, 148 and 150 together with the top surface of bottom wall 110 function to provide multi-directional entry of the refrigerated air band into the cooling tube core 142. The greater number of directions of inflow through the front air opening 154 and the side air opening 152 results in a diffusion of the frost and ice buildup internally within the cooling tube core. During a defrost cycle the defrost air band (shown in dotted arrows) is propelled through the cooling tube core 142 and out of both of the side air opening 152 and the front end 154 in order to quickly defrost the same. The calrod 164 and its reflector 166 add heat to the ambient air drawn into the air opening 130 by the fan unit 138. The result of the frost diffusion system thus described is that the case 108 can operate for longer time periods in a refrigeration cycle and then when a defrost cycle is initiated the defrost cycle is shorter than in conventional evaporator units. With the improved evaporator unit of the present invention as herein described the number of defrost cycles per day is reduced by one-half. Also the defrost time per cycle is reduced by one-third without the use of a calrod heater due to greater defrost air flow through. Additional defrost time reduction can be achieved by the use of the calrod.

Open Front Cases

FIG. 4 shows an open front single air band refrigerated display case 170 which is supported on a base 172. A bottom wall 174 is supported on the base 172 and has a front configured wall 176 and a vertical rear wall 178 attached to front and rear edges thereof, respectfully. A top wall 180 is, in turn, connected to the upper end of vertical wall 178. A product storage compartment 182 is formed within the case 170 by a lower compartment panel 184 which is spaced above the lower wall 174 and to which a front conduit panel 186 is connected at the front edge and a vertical rear conduit panel 188 is connected by the rear end. Panel 188 is disposed spaced from and parallel to the rear outer wall 178. Also a top conduit panel 190 is spaced below the top outer wall 180 as shown. An air opening 192 is provided at the top front position of the outer top wall 180 and the top compartment 190. An air diffuser grid 194 is provided to cover the opening 192. A refrigerated air band receiving opening 196 is positioned between the outer configured front wall 176 and the inner configured conduit panel 186 with an air diffuser grid 198 positioned there across.

An evaporator unit 200 and an air propelling fan and mounting bracket unit 202 are positioned in the space between the bottom lower wall 174 and the lower compartment panel 184. The lower bottom wall 174 is configured to function as a guide panel 204 in order to channel the refrigerated air flow through the cooling tube core 206 of the evaporator unit 200. The bottom surface 208 of the bottom compartment panel 184 also functions as an air guide means in order to guide a portion of the refrigerated air band through the side air opening 210 of the cooling tube core 206 so that a part of the refrigerated air band does not flow through the front air opening to 212. Due to this construction of the evaporator unit 200 the frost and ice is diffused within the internal components of the cooling tube core 206. In the refrigeration cycle the air is propelled through the evaporator unit 200 in the direction shown by the solid arrows, i.e., clockwise through air conduit 214.

During a defrost cycle of operation the air band direction is reversed by the fan in the fan unit 202 and the air flow through conduit 214 is in the counter clockwise direction. The ambient air taken in through air opening 192 at the top of the case 170 is circulated through the conduit 214 and into the back end 216 of the cooling tube core 206. The defrost air band then flows through the cooling tube core and outwardly through the said air opening 210 and the front air opening 212. The defrost air band then exits from the case 170 through air opening 196.

In FIG. 4 the case 170 is shown with an end wall 218 which has a front configured edge 220 and a rear edge 222 which extends rearwardly from the rear outer wall 178. Also a configured lower front portion 224 is provided for this end wall. While it is not conventional in the art of refrigerated display cabinets to illustrate side panels such as 218 it will be appreciated that such side walls can be provided for the other cases described herein.

Refrigerated case 170 is provided with a top light hood 226 and product shelves 228 and 230. Also a moveable false bottom 232 is provided in order to elevate product stored within compartment 182. A drain 234 is also provided for water formed by melting of the frost and ice during the defrost cycle.

FIG. 5 illustrates the present invention in a multiconduit open front display cabinet 240. A sloped outer bottom wall 242 having a raised front portion is supported on legs 244 and 246. A front wall 248 is connected to the front end of bottom wall 242 and a vertical rear outer wall 250 is connected to the rear edge thereof. The top outer wall 252 is provided with an air propelling fan space 254 and a front planar portion 256. A product storage compartment 258 is contained within the above described outer walls and is formed by a bottom compartment panel 260 which has a front panel 262 connected to the front edge thereof and a rearwardly sloped rear panel 264 connected to the rear edge thereof. The top edge of the rear panel 264 is connected to a top inner panel 266. A primary air conduit 268 is formed between the outer surfaces of the compartment panels 260, 262, 264 and 266 and a spaced set of divider panels 270, 272, 274, 276 and 278 which are connected in series and are spaced from the outer case walls. These divider panels are thus arranged to form a secondary air conduit 280 which extends from the lower front of the case in a counter clockwise direction to a position under the planar top outer panel 256.

The primary conduit 268 has an air ooening 282 at the top of the inner compartment front panel 262 and a corresponding top air outlet 284 formed between the front edqes of the top compartment panel 266 and the divider panel 278. An air guide skirt 288 is provided to direct a primary air band downwardly from the primary air conduit 268. The primary air band is propelled through the air conduit 268 by the air fan and mounting bracket unit 290 which is positioned within the air conduit 268 betweeen the lower compartment panel 260 and the divider panel 272. The primary air band is propelled in a counter clockwise direction during the refrigeration cycle as shown by the solid arrows. A secondary guard air band is also propelled through the secondary conduit 280 in the same counter clockwise direction during the refrigeration cycle by means of operation of a secondary air fan and mounting bracket unit 292.

The primary air band flowing through air conduit 268 is cooled by passage through the evaporator unit 294 which is composed of a cooling tube core 296 and the associated compartment and divider panels 260 and 274 respectively. The positioning of these panels with respect to the outer configuration of the cooling tube core 296 is such that these panels function as air guide panels in order to permit a portion of the refrigerated air band to flow through front air opening 298 of the cooling tube core 296 and an auxiliary portion of the air band to flow through the side air opening 300 of the tube core 296. The multiple directions of inflow permit diffusion of the frost and ice buildup within the components of the tube core. Also a calrod and reflector shield unit 302 is provided adjacent the side air opening 300 in order to add radiant energy into the defrost air stream denoted by dashed arrows. The defrost air flow through the primary conduit 268 is then in a clockwise direction as propelled by the fan unit 290. The defrost air is taken in through air opening 284 at the top of the case and propelled through the primary conduit 268, through the evaporator unit 294 and then out of air opening 282 and into the ambient air as shown. During the defrost cycle the secondary air fan 292 is not operated.

An ambient guard air band hood 304 is spaced above the planar top wall 256 for use in both the refrigeration and the defrost cycles. An ambient air fan 306 is positioned within the hood 304 for the generation of an ambient air band shown by the outer solid arrows during a refrigeration cycle. During the defrost cycle fan 306 is also operated and the defrost air shown by dashed arrows is caused to flow downwardly and this band is then sucked into the primary conduit 268 by operation of the fan unit 290. In this fashion ambient air which is located above the top of the open front case 240 is utilized to defrost the cooling tube core 296. An ambient air outlet opening 308 is provided at the front edge of the top planar wall 256. Also a secondary conduit air opening 310 is formed between the ambient air outlet and the primary air band directional skirt 288.

At the opposite end of the secondary air conduit 280 an air opening 312 is provided below an air diffuser grill 314 which also covers the primary air conduit opening 282.

A series of product storage shelves 316, 318, 320 and 322 are provided within the product display compartment 258. Also a drain 324 and a water opening 326 are provided for the drainage of water from the cooling tube core during a defrost cycle.

A top front light hood 328 and an electrical storage compartment 330 are also provided at the top of the case 240.

Details of Cooling Tube Core

FIG. 6 shows the internal components of a cooling tube core 340. A cooling tube 342 is arranged in a serpentine fashion between side walls 344 and 346. The outer loops can also be positioned outside of these side walls, if desired. Usually a second or a third cooling tube is spaced from tube 342 in a plane parallel to the plane illustrated. A series of cooling fins 348–362 are arranged parallel to the outer walls 344 and 346. The refrigerated air flow between the series of cooling fins and across the cooling tube 342 is illustrated by the solid arrows.

In this preferred modification of an evaporator unit 340 according to the present invention, the adjacent cooling fins are staggered by having the front end portions of fins 348, 352, 356 and 360 connected to the front positioned length 362 of the tube 342. The adjacent alternate cooling fins 350, 354, 358 and 362 are then connected to the third length 362 of the cooling tube.

In use the refrigerated air band has entrained moisture by reason of its contact with the ambient air over the access opening(s) of the above described refrigerated display cases in FIGS. 1–5. This moisture then builds up on the leading edge portions of the fins as shown so that an air flow channel remains even for quite heavy frosting since the frost formations are not juxtaposed. In conventional arrangements of the cooling fins wherein all of the fins are connected to the first length of the cooling tube 362 the build-up of moisture can quickly block off the flow into the front air opening 366 of the evaporator unit 340 as shown in phantom lines.

In this preferred embodiment a calrod 368 is positioned across the top side of the evaporator unit 340 contiguous with the position of the staggered cooling fins 350, 354, 358 and 362. This positioning of the calrod results in a quick melting of the main ice and frost formation at the leading edge portions of the cooling fins.

The improved evaporator units of the present invention can be manufactured as articles of manufacture which can include the cooling tube core and the associated air guide panels. Such articles of manufacture can then be placed directly into refrigerated display cases during manufacturing of the same. Also the evaporator units can be combined with the air propelling fans in order to make a complete unit of manufacture for the same purpose. Another alternative is to specially configure the lower compartment panel in the display cases in order to provide for the air guide panel functioning.

Each of these three different modes of utilizing the present invention will be apparent from FIGS. 7–12 which show various modifications of the improved evaporator unit of the present invention.

Figure 7:
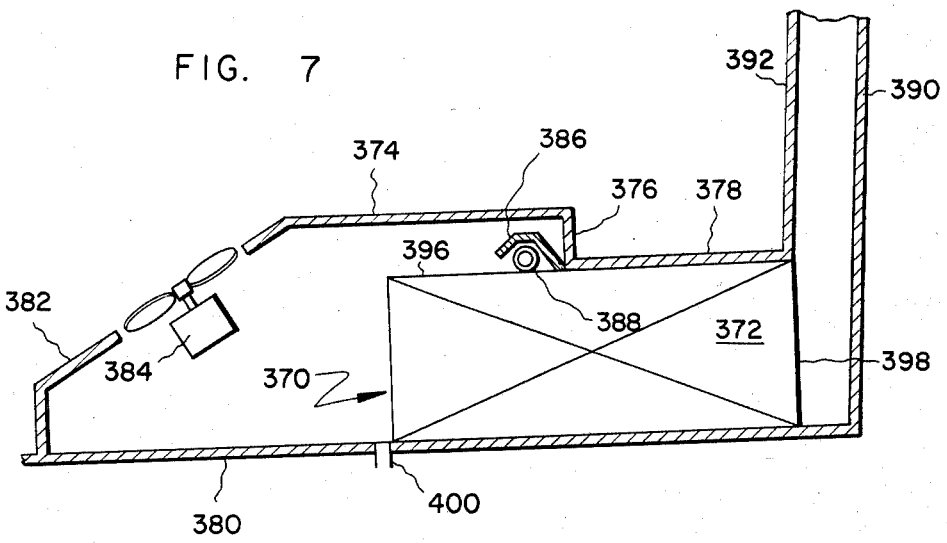
FIG. 7 is a cross-sectional view of a modification of the improved evaporator unit of the present invention shown having a calrod and heat reflector.

FIG. 7 shows an enlarged cross-sectional view of an evaporator unit 370 which is composed of a cooling tube core 372 and air guide panels 374, 376 and 378 located on the top thereof. The bottom wall 380 of a refrigerated display cabinet provides the lower air guide panel. The fan mounting panel 382 is formed as an extension of the air guide panel 374 for providing the positioning of an air propelling fan 384.

A heat reflector shield 386 is provided as an extension of air guide panel 378 and has a calrod 388 located under the reflector and above the top surface of the cooling tube core 372. Air conduit wall 390 is connected to the rear edge of bottom wall 380 and another air conduit wall 392 is connected to the rear edge of air guide panel 378. During a refrigeration cycle a refrigerated air band is propelled through the evaporator unit 370 by fan 384 as shown by the solid arrows so that a portion of the air band is propelled through front air opening 394 of cooling tube core 372 and an auxiliary portion of the air band is propelled through side air opening 396 in order to distribute the frost buildup over the cooling tube and fins within the cooling tube core 372. The entire refrigerated air band then flows through the back air opening 398 of the cooling tube core.

During a defrost cycle of operation the fan 384 is operated in a reverse direction to cause a defrost air band to move through the evaporator unit 370 in the opposite direction as shown by the dashed arrows.

A water drain opening 400 is provided through bottom wall 380.

Figure 8:
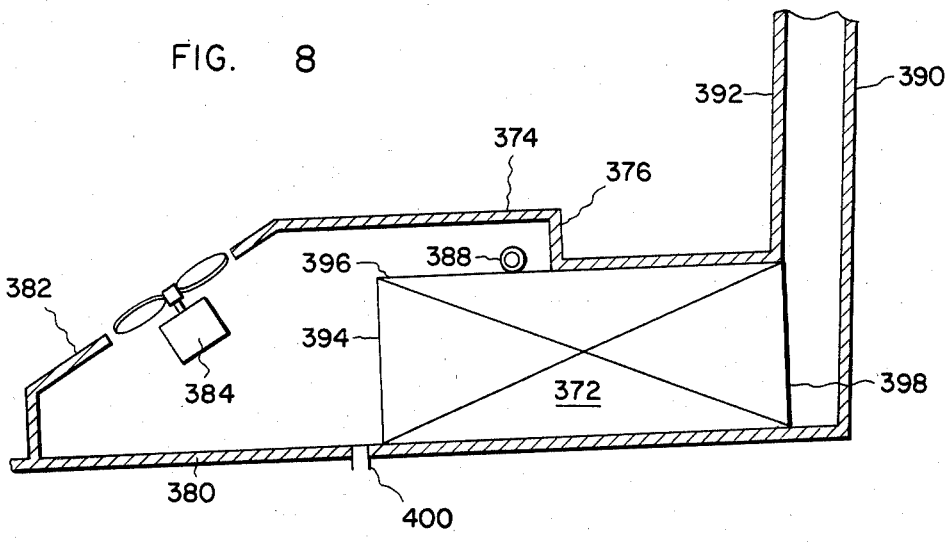
FIG. 8 is a cross-sectional view of an improved evaporator unit according to the present invention with a calrod shown positioned at the top thereof.

FIG. 8 shows another modification of the evaporator unit 370 wherein no heat reflector shield is provided for calrod 388. The surrounding air guide panels 374 and 376 provide a similar heat reflecting function in this embodiment. The other descriptive numerals are identical to FIG. 7 above. Calrod 388 is an electrical resistance heater which can be operated during defrost over a wide temperature range of from about 120° F. to 400° F.

Figure 9:
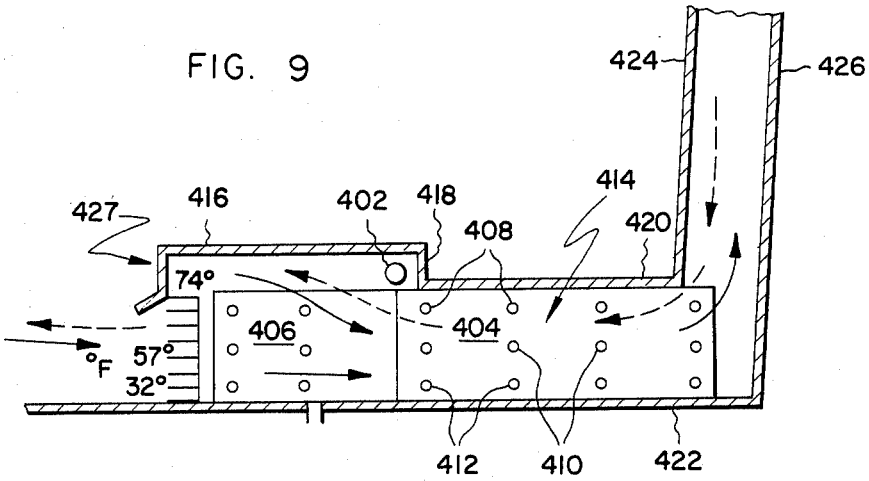
FIG. 9 is a detailed view of a preferred embodiment of the present invention showing a calrod positioned over the staggered fin position within the improved evaporator unit.
Figure 10:
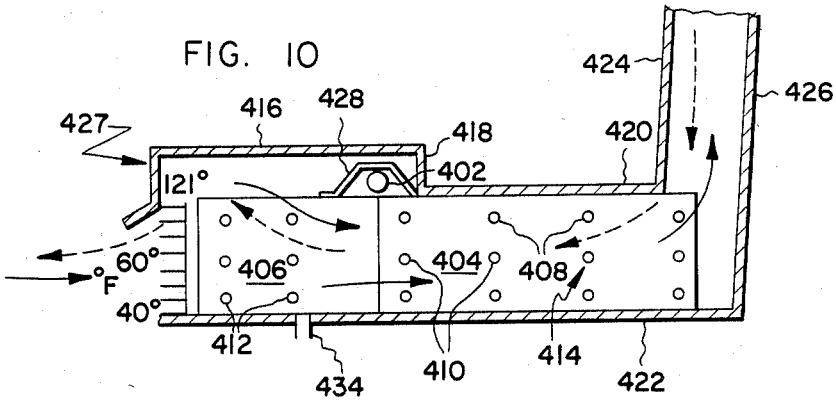
FIG. 10 is a modification of the preferred embodiment of FIG. 9 wherein a heat reflecting shield is provided for the calrod.
Figure 11:
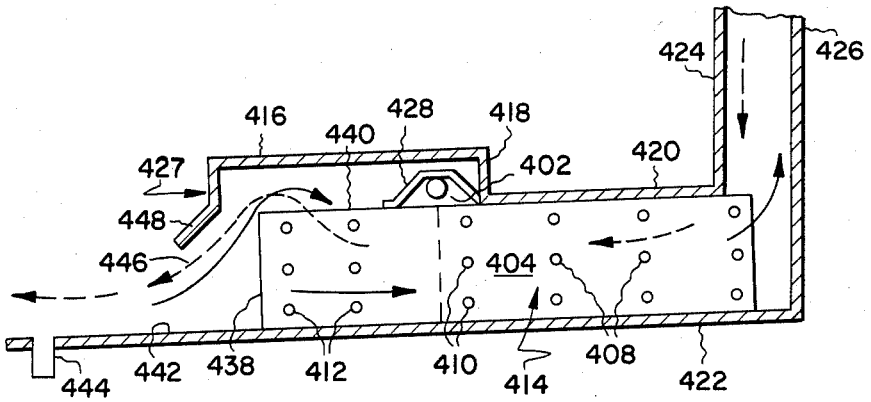
FIG. 11 is a detailed cross-sectional view of a preferred embodiment of the present invention.

FIGS. 9, 10 and 11 show another embodiment of the improved evaporator unit of the present invention wherein a calrod 402 is positioned contiguous to the front edge portion of the staggered positioned fins illustrated by fin 404 in the cross-sectional view shown. The adjacent full length cooling fin 406 is also shown as is the six lengths of the three cooling tubes 408, 410 and 412. The relative positioning of the serpentine configured cooling tubes 408, 410 and 412 can be fully appreciated by interpreting FIGS. 9, 10 and 11 by reference to FIG. 6.

The cooling tube core 414 composed of the above described elements is contained between the air guide panels 416, 418 and 420 at the top and the air guide panel 422 at the bottom. Air guide panels 420 and 422 are in turn connected to vertical conduit panels 424 and 426 respectively. The air guide panels 416 and 418 provide limited heat reflector functions for calrod 402.

Also shown in FIGS. 9, 10 and 11 is the defrost air deflector panel 427 which forces the defrost air flow across the front end of the cooling tube core 414 and downward against the bottom air guide panel or drain pan 422. The advantageous defrost air flow for this preferred feature is further described with reference to FIGS. 11 and 12, below.

MODE OF OPERATION

In FIG. 10 the preferred embodiment is shown with a heat reflector shield 428 provided for calrod 402. The effect of this heat reflector shield is to raise the defrost temperature in the cooling tube core 414. In this FIG. 10 embodiment the calrod 402 and the reflector shield 428 are positioned contiguous to the staggered position of the fins. This preferred embodiment is also equipped with a defrost air deflector panel 427. The temperatures shown in FIGS. 9 and 10 were taken at the positions illustrated next to the front end of the cooling tube core at the termination of the defrost cycle. This comparative test was carried out in an open top single band frozen food display case. In the modification shown in FIG. 9 a defrost cycle time of 46 minutes was required for complete defrosting. In the modification shown in FIG. 10 a defrost cycle time of 39 minutes was recorded. The pan temperature in the modification of FIG. 9 was 32° whereas in FIG. 10 the pan temperature was 40° . The top portion of the cooling tube core of FIG. 10 showed a temperature of 121° F. which is considerably above the 74° F. recorded for the modification without the heat reflector shield shown in FIG. 9. Both of these modifications enabled satisfactory display case operation with only two defrost cycles in a twenty-four hour period.

In FIGS. 9–10 water drains 434 have been provided.

FIG. 11 shows the defrost air flow pattern for the preferred embodiment of FIG. 10 in detail. The defrost air guide panels are configured to enable improved defrost action across the front air opening of the evaporator unit and across the drain pan.

The defrost air deflector panel 427 is shown attached to the top air guide panel 416 in an adjacent position to the front air opening 439 of evaporator unit 414. This defrost air deflector panel 427 forces the defrost air stream flowing through the top side 440 of the evaporator unit to be deflected downwardly across the front end 438 and then across the drain pan 442. The drain 444 is also defrosted and kept clear of ice blockage by the same defrost air flow which is illustrated by the dotted arrow 446. The deflector panel 427 preferably has an air guide vane 448 at its terminal end.

Figure 12:
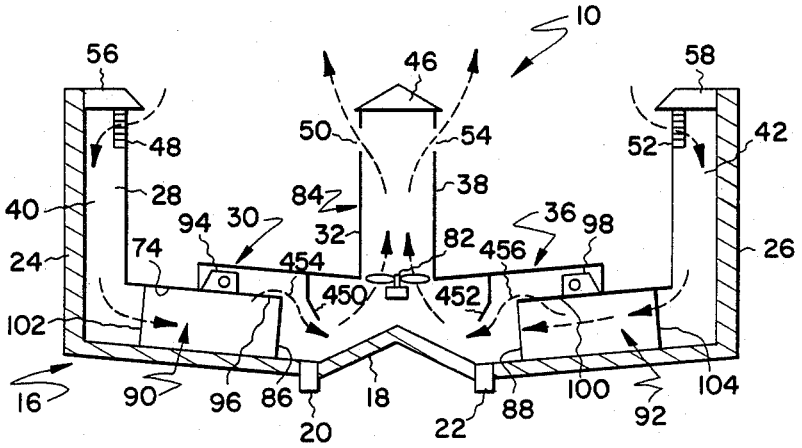
FIG. 12 is a schematic cross-sectional view of an open top island-type display case showing the use of the embodiment illustrated in FIG. 11.

FIG. 12 shows defrost air deflector panels added to the open top refrigerated display case illustrated in FIG. 2, above. The deflector panels 450 and 452 are shown extending downwardly from the underside of bottom conduit walls 30 and 32 so that they are adjacent to the front ends of the two cooling units 90 and 92. Defrost air flow streams through the side openings 96 and 100 of these two cooling units 90 and 92, respectively are deflected so as to flow across front ends 86 and 88 and then downwardly toward drains 20 and 22 which are in the drain pan or bottom wall 16. Since the air deflector panels 450 and 452 are effective mainly in the defrost cycle the solid refrigeration air flow arrows shown in FIG. 2 have been omitted in FIG. 12.

The defrost air flow streams 454 and 456 are then guided to flow across the front air openings 86 and 88 of the cooling units 90 and 92 to enable fast and efficient defrosting.

The evaporator unit of the present invention is constructed with guide panels which permit an auxiliary part of the air band propelled through the apparatus during a refrigeration cycle to bypass the front air opening of the cooling tube core and to flow adjacent to the second air opening of the core when measured in the direction of the primary air band flow. This substantial length is usually from 40% to 85% of the full length of the cooling core when measured in that same direction.

The cooling tube core is placed in the surrounding guide panels so that the portions not in contact with these panels form air openings to permit the unimpeded through flow of air into the cooling tube core. There are no perforated or slotted housing or casing panels arranged in contact with the cooling fins over the front, side, and back air openings to impede the air flow-through or to cause further frost and ice build up. Also the spacing of the main guide panel away from the side air opening is sufficient to assure flow of the auxiliary air stream during the refrigeration cycle simultaneously with the main air band flow through the front air opening.

Another feature is that the guide or housing panels in contact with the cooling tube core are smooth surfaced and are thus adapted to permit the unimpeded nonturbulent through-flow of both the air band to be cooled during the refrigeration cycle and the defrost air band during the defrost cycle. This smooth flow through is more energy efficient than is turbulent flow within the cooling tube core. Examples of the smooth surfaced panels are elements 378 and 380 in FIGS. 7 and 8 and 420 and 422 in FIGS. 9 and 10.

It is also possible to further assist the quick defrosting of the cooling tube cores by passing hot liquid or gaseous refrigerant through them from the high pressure side of the refrigeration circuit.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. In a refrigerated container apparatus having a plurality of outer walls and a product storage compartment located therein, an air conduit adapted to conduct refrigerated air within said apparatus, and air moving means for propelling an air band within said air conduit in a first direction during a refrigeration cycle and in a second direction during a defrost cycle and an access opening for placing and withdrawing products into and from said storage compartment, the improvement comprising:

an evaporator unit having a cooling tube core and associated guide panels, said cooling tube core having a front air opening, at least one side air opening, and a back air opening positioned for permitting unimpeded flow through of said propelled air band;

said evaporator unit adapted to permit simultaneous inflow of said air band from at least, two directions during the refrigeration cycle, one of which is into said front air opening and another of which is into said side air opening for contact with said cooling tube core to diffuse frost formation uniformly during the refrigeration cycle, and said guide panels adapted to permit a part of said air band to bypass said front air opening of said cooling tube core and to flow adjacent to a substantial length of said side air opening prior to flow thereinto during the refrigeration cycle and to direct said air band flow out of said cooling tube core through said back air opening and said guide panels adapted to permit reverse air flow through said air openings during a defrost cycle.

2. The improvement in a refrigerated container apparatus according to claim 1, wherein said cooling tube core is positioned within said air conduit to permit said air band to flow through said front air opening from a direction aligned with the center plane of said air conduit, and wherein said associated guide panels permit a part of said air band to flow adjacent to said cooling tube core and through said side air opening from at least a second direction.

3. The improvement in a refrigerated container apparatus according to claim 1, wherein a first of said guide panels is positioned at a spaced distance away from said side air opening and wherein a rear portion thereof contacts said cooling tube core, and wherein a second of said guide panels is positioned in contact with an opposite side portion of said cooling tube core.

4. The improvement in a refrigerated container apparatus according to claim 1, wherein said cooling tube core is positioned within said air conduit for first contact by an end thereof with a primary portion of said air band flowing in a direction defined by the center plane of said air conduit; said associated guide panels adapted to permit flow of an auxiliary portion of said air band along at least one side of said cooling tube core in the direction of air flow and said panels also adapted to direct inflow of said auxiliary portion into said cooling tube core from directions differant from the flow direction of said primary portion.

5. The improvement in a refrigerated container apparatus according to claim 1, wherein said associated guide panels are formed by said air conduit surfaces of said apparatus.

6. The improvement according to claim 1, wherein a heater element adapted for operation during the defrost cycle is positioned adjacent to a portion of said side air opening of said cooling tube core.

7. The improvement in a refrigerated container apparatus according to claim 1, wherein said cooling tube core is formed by a serpentine configured cooling tube and a series of parallel arranged cooling fins, said fins longitudinally arranged within said air conduit and having end edges and side edges, said cooling tube core arranged to permit first contact with said air band by said end edges of said fins, said associated housing panels permitting bypass flow of a portion of said air band along said side edges of said fins and arranged to direct said bypass portion of said air band through said side air opening and into said cooling tube core along said side edges.

8. The improvement in a refrigerated container apparatus according to claim 7, wherein a selected portion of said cooling fins are positioned with the end edges thereof out of alignment with the end edges of the remaining cooling fins, the end edge positioning of said selected portion of said fins forming a staggered fin position within said evaporator unit.

9. The improvement in a refrigerated container apparatus according to claim 8, wherein a heater element is juxtaposed to said cooling tube core in the vicinity of said staggered fin position.

10. The improvement in a refrigerated container apparatus according to claims 6 or 9, wherein a heat reflector shield is provided for directing heat emitted from said heater element into said cooling tube core.

11. The improvement in a refrigerated container apparatus according to claim 1, wherein said guide panels include a defrost air deflector panel positioned adjacent to said front air opening and which is adapted to guide the flow of air during a defrost cycle to flow across said front air opening.

12. A refrigerated container apparatus having a plurality of outer walls and a product storage compartment located therein, an air conduit adapted to conduct refrigerated air within said apparatus, an air moving means for propelling an air band within said air conduit in a first direction during a refrigeration cycle and in a second direction during a defrost cycle, and an access opening for placing and withdrawing products into and from said storage compartment; said apparatus comprising:

an evaporator unit having a cooling tube core and associated guide panels, said cooling tube core having a front air opening, at least one side air opening, and a back air opening position for permitting unimpeded flow through of said propelled air band;

said evaporator unit adapted to permit simultaneous inflow of said air band from at least two directions during the refrigeration cycle, one of which directions is into said front air opening and another of which is into said side air opening for contact with said cooling tube core to diffuse frost formation uniformly during the refrigeration cycle, and to permit a part of said air band to bypass said front air opening of said cooling tube core and to flow adjacent to a substantial length of said side air opening prior to flow thereinto during the refrigeration cycle and to direct said air band flow out of said cooling tube core through said back air opening; and said guide panels adapted to permit reverse air flow through said air openings during a defrost cycle to effect an efficient defrosting of said cooling tube core.

13. The apparatus according to claim 12, wherein said cooling tube core is positioned within said air conduit to permit said air band to flow through said front air opening from a direction aligned with the center plane of said air conduit, and wherein said associated guide panels permit a part of said air band to flow adjacent to a substantial length of said cooling tube core and through said side air opening from at least a second direction.

14. The apparatus according to claim 12, wherein a first of said guide panels is positioned at a spaced distance away from said side air opening and wherein a rear portion of said first guide panel contacts said cooling tube core, and wherein a second of said guide panels is positioned in contact with an opposite side portion of said cooling tube core.

15. The apparatus according to claim 12, wherein a heater element adapted for operation during the defrost cycle is positioned adjacent to a portion of said side air opening of said cooling tube core.

16. The apparatus according to claim 12, wherein said cooling tube core is formed by a serpentine configured cooling tube and a series of parallel cooling tube fins, said fins longitudinally arranged within said air conduit and having end edges and side edges, said cooling tube core arranged to permit first contact by said air band at said end edges of said fins, said associated guide panels permitting bypass flow of a portion of said air band along said side edges of said fins and arranged to direct said bypass portion of said air band through said side air opening and into said cooling tube core along said side edges.

17. The apparatus according to claim 16, wherein a selected portion of said cooling fins are positioned with the end edges thereof out of alignment with the end edges of the remaining cooling fins, the end edge positioning of said selected portion of said fins forming a staggered fin position within said evaporator unit.

18. The apparatus according to claim 17, wherein a heater element is juxtaposed to said evaporator unit in vicinity of said staggered fin position.

19. The apparatus according to claims 15 or 17, wherein a heat reflector shield is provided for directing heat emitted from said heater element into said cooling tube core.

20. The apparatus according to claim 12, wherein said guide panels include a defrost air deflector panel positioned adjacent to said front air opening and which is adapted to guide the flow of air during a defrost cycle to flow across said frost air opening.

21. An evaporator unit for use in a refrigerated container apparatus which is formed of a plurality of outer walls and which has a product storage compartment located therein and in which an air conduit is positioned for permitting the flow of refrigerated air within the apparatus and air moving means for propelling an air band within said air conduit in a first direction during a refrigeration cycle and in a second direction during a defrost cycle; said evaporator unit comprising a cooling tube core and associated housing panels, said cooling tube core located within said housing panels and adapted for contact by an air band propelled within said conduit during both the refrigeration and the defrost cycles, said cooling tube core having a front air opening, at least one side opening and a back air opening positioned for permitting unimpeded flow through of said propelled air band; said cooling tube core and associated housing panels adapted to permit simultaneous inflow of said air band from at least two directions during the refrigeration cycles, one of which is into said front air opening and another of which is into said side air opening for contact with said cooling tube core to diffuse frost formation uniformly during the refrigeration cycle, and to permit a part of said air band to bypass said front air opening of said cooling tube core and to flow adjacent to a substantial length of said side air opening prior to flow thereinto during the refrigeration cycle and to direct said air band flow out of said cooling tube core through said back air opening.

22. The evaporator unit according to claim 21, wherein said cooling tube core is positioned within said air conduit to permit flow of said propelled air band into said front air opening from a direction aligned with the center plane of said air conduit, and wherein said associated housing panels permit flow of a part of said air band into said cooling tube core from at least a second direction.

23. The evaporator unit according to claim 21, wherein said cooling tube core is positioned within said air conduit for first contact by an end thereof with a primary portion of the air flowing within said air conduit, said associated panels adapted to permit flow of an auxiliary portion of air along at least one side of said cooling tube core in the direction of air flow and said housing panels also adapted to direct inflow of the auxiliary portion into said cooling tube core from at least one direction different from the flow direction of said primary portion.

24. The evaporator unit according to claim 21, wherein said associated housing panels are formed by said air conduit surfaces of said apparatus.

25. The evaporator unit according to claim 21, wherein a heater element is arranged within said evaporator unit in juxtaposition to said cooling tube core.

26. The evaporator unit according to claim 21, wherein said cooling tube core is formed by a serpentine configured cooling tube and a series of parallel arranged cooling fins, said fins longitudinally arranged within said air conduit and having end edges and side edges, said cooling tube core arranged to permit first contact by said air band at said end edges of said fins, said associated housing panels permitting bypass flow of a portion of said air band along said side edges of said fins and arranged to direct said bypass portion of said air band through said side air opening and into said cooling tube core along said side edges.

27. The evaporator unit according to claim 26, wherein a selected portion of said cooling fins are positioned with the end edges thereof out of alignment with the end edges of the remaining cooling fins, the end edge positioning of said selected portion of said fins forming a staggered fin position within said evaporator unit.

28. The evaporator unit according to claim 27, wherein a heater element is juxtaposed to said cooling tube core in the vicinity of said staggered fin position.

29. The evaporator unit according to claims 25 or 27, wherein a heat reflector shield is provided for directing heat emitted from said heater element into said cooling tube core.

30. The evaporator unit according to claim 21, wherein said housing panels include a defrost air deflector panel positioned adjacent to said front air opening and which is adapted to guide the flow of air during a defrost cycle to flow across said front air opening.

31. The process of operating a refrigerated container apparatus having: a plurality of outer walls and a product storage compartment located therein, an air conduit adapted to conduct the refrigerated air within said apparatus, an air moving means for propelling an air band within said air conduit in a first direction during a refrigeration cycle and in a second direction during a defrost cycle, an evaporator unit having a cooling tube core and associated guide panels which permit unimpeded entry of the air band through the cooling tube core through a front air opening and at least one side air opening during the refrigeration cycle and for permitting air flow in the reverse direction during a defrost cycle through a back air opening and both of the front and side air openings, and an access opening for placing and withdrawing products into and from said storage compartment, the process comprising the steps of:

propelling an air band within said air conduit in a first direction during a refrigeration cycle;

separating said air band into a primary portion and an auxiliary portion prior to inflow into said cooling tube core;

causing the primary portion of said air band to flow through the front air opening of the cooling tube core;

causing the auxiliary portion of said air band to flow through the side air opening of the cooling tube core to diffuse frost formation uniformly during the refrigeration cycle;

terminating the operation of the cooling tube core and reversing the direction of the air moving means; and propelling defrost air through the back air opening of said cooling tube core and out of the front air opening and side air opening of the core to defrost the same.

32. The process according to claim 31, including the further step of:

during the defrost cycle, adding heat into the cooling tube core from a position between one of the associated guide panels and the cooling tube core.

33. The process according to claim 31, wherein the refrigerated container apparatus contains a heater element juxtaposed to the cooling tube core and positioned adjacent to one of the associated guide panels and wherein a heat reflector shield is provided in association with the heater element, said process including the further defrost steps of:

supplying heat energy from the heater element into the cooling tube core; and reflecting the heat emitted from the heater element into the cooling tube core.

34. The process according to claim 31, including the further step of:

during the defrost cycle, deflecting the air flow across the front air opening to defrost the same.

* * * * *